US005551204A

United States Patent [19]

Mayrand

[11] Patent Number: 5,551,204

[45] Date of Patent: Sep. 3, 1996

[54] COMPOSITE STRUCTURAL STEEL WALL REINFORCED WITH CONCRETE AND MOLD THEREFOR

[76] Inventor: Paul Mayrand, 11 rue de L'Armistice, Blainville, Quebec, Canada

[21] Appl. No.: 234,127

[22] Filed: Apr. 28, 1994

[51] Int. Cl.[6] ..... E04C 2/32

[52] U.S. Cl. ..... 52/795.1; 52/799.1

[58] Field of Search ..... 52/795, 799, 800, 52/801, 726.1, 578, 702; 403/232.1, 283

[56] References Cited

U.S. PATENT DOCUMENTS

| | | | |
|---|---|---|---|
| 2,616,283 | 11/1952 | Branstrater et al. | 52/795 X |
| 3,195,699 | 7/1965 | Johnston . | |
| 3,341,395 | 7/1967 | Weber | 52/799 X |
| 3,481,093 | 12/1969 | Davidson . | |
| 4,321,779 | 3/1982 | Kratchmer . | |
| 4,433,522 | 2/1984 | Yerushalmi . | |
| 4,962,622 | 10/1990 | Albrecht et al. | 52/795 X |

*Primary Examiner*—Creighton Smith

*Attorney, Agent, or Firm*—Swabey Ogilvy Renault; Guy J. Houle

[57] ABSTRACT

A composite structural steel wall reinforced with concrete and a form system is described herein. The wall comprises a corrugated steel sheet defining a plurality of integrally formed, alternately inverted, spaced ridges. The ridges extend on opposed sides of the sheet and are separated by troughs defined by a rear face of the ridges on an opposite one of the sides and an integrally formed side wall of opposed ridges on a common side of the sheet. The side walls have openings therein. A first wall structure is secured to at least some of the ridges on one of the opposed sides of the corrugated steel sheet. A second wall structure is secured to at least some of the ridges on the other of the opposed sides of the corrugated steel sheet. The first and second wall structures form at least an integral part of the finished wall surfaces and are spaced apart and interconnected substantially parallel to one another by the corrugated steel sheet whereby to constitute a form to receive concrete from a top end thereof to form the structural steel wall reinforced with concrete.

20 Claims, 6 Drawing Sheets

COMPOSITE STRUCTURAL STEEL WALL REINFORCED WITH CONCRETE AND MOLD THEREFOR

TECHNICAL FIELD

The present invention relates to a composite structural steel wall reinforced with concrete and wherein the form is formed by a corrugated steel sheet and opposed wall structures secured to ridges of the sheet on opposed sides thereof with the wall structures forming part of a finished wall after concrete has been poured between the ridges of the sheet between the opposed wall structures secured thereto.

BACKGROUND ART

Composite wall structures are known wherein concrete is poured in elongated channels formed by opposed wall structures and examples thereof are described in U.S. Pat. Nos. 3,195,699 and 3,481,093. In the first one of these patents, the forms are constituted by wet-resistant cardboard or strong paper spaced by Z cross-section flanges which are glued to the wall skins. Cavities are provided in these webs for concrete to flow between the webs to form a simple concrete wall. In the second one of these patents, the wall structure is provided by two spaced-apart metal sheets which are self-supporting and wherein a space defined between the sheets is filled with a bonding material whereby these panels are interconnected to form a solid core wall structure and form in a simple concrete wall. U.S. Pat. No. 4,433,522 also describes a wall structure comprising a plurality of steel elements interconnected together to form a hollow wall with joints therein and wherein concrete can be poured within the hollow wall to constitute a protective wall structure having a high resistance to blasts and fragments. It is also known to interconnect wall elements in two parallel rows with the wall elements being laid in courses and interconnected by connecting rods to maintain the wall elements in place when concrete is poured therebetween. Such a wall structure is described in U.S. Pat. No. 4,321,779 and form a simple concrete wall.

SUMMARY OF INVENTION

The use of a thin (for example 22 gauge 0.0299 inch) corrugated steel sheet as a vertical structural component for building walls is unworkable, mainly because of the thin steel. The corrugated steel sheet as we know it is generally used as a horizontal form to support concrete.

The present invention allows the use of a new type of corrugated steel sheet, as described herein, as a part of a vertical structural component and as a component to attach vertical wall forms that support freshly mixed concrete. The use of our new corrugated steel sheet as a vertical structural component is optimized and becomes viable if the loads from upper elements are uniformly distributed through the section of the steel sheet. To do so, we have developed a double composite effect. By embossing the sheet with a bead pattern on the inner side walls of the corrugated steel sheet and the use of concrete on each side of the walls of the steel sheet, the double composite effect becomes possible. This combination allows us to obtain the full bearing strength availability of the corrugated steel sheet as a vertical component. The main function of the concrete is to insure full load transfer to the steel walls. Thus, the present invention provides a composite structural steel wall reinforced with concrete.

To maximize the lateral strength of the wall in its own plane, openings are provided in the side walls of the steel sheet, at regular intervals, to insure horizontal continuous concrete distributions throughout the wall.

Because the corrugated steel sheets are made of thin steel, the form walls are easily fastened thereto by screws. It is therefore simple to erect the form. The configuration of the corrugated steel sheet allows the use of products for form walls such as rigid insulation and gypsum boards as permanent form walls. The shape of the corrugated steel sheet provides a reduction in the pressure caused by the concrete and applied to the wall components. A regular gypsum board secured to the corrugated steel sheet is able to support the pressure from fresh concrete in a wall, for example, of eight feet high and three inches thick.

It is a feature of the present invention to provide a novel composite structural steel wall which is reinforced with concrete and which provides various advantages not heretofore taught by the prior art.

Another feature of the present invention is to provide a composite structural steel wall reinforced with concrete and wherein the wall is formed essentially by a corrugated steel sheet having opposed wall structures secured thereto to constitute a form wherein concrete can be poured from the top end of the form and with the opposed wall structures forming part of the finished structural steel wall.

Another feature of the present invention is to provide a composite structural steel wall reinforced with concrete and wherein the walls can be erected quickly whether the concrete has set or not, and the wall becomes free-standing with no formwork having to be removed with the exception of braces to support the form wall in a stable vertical position to receive concrete.

Another feature of the present invention is to provide a form system for a composite structural steel wall reinforced with concrete and having advantages not heretofore provided by the prior art.

According to the above features, from a broad aspect, the present invention provides a composite structural steel wall reinforced with concrete and comprised of a corrugated steel sheet defining a plurality of integrally formed, alternately inverted, spaced ridges. The ridges are provided on opposed sides of the sheet and separated by troughs defined by a rear face of the 7ridges on an opposite one of the sides of the sheet and an integrally formed side wall of opposed ridges on a common side of the sheet. The side walls have openings therein. A first wall structure is secured to at least some of the ridges on one of the opposed sides of the corrugated steel sheet. A second wall structure is secured to at least some of the ridges on the other of the opposed sides of the corrugated steel sheet. The first and second wall structures form at least an integral part of the finished wall surfaces and are spaced-apart and interconnected substantially parallel to one another by the corrugated steel sheet whereby to constitute a form to receive concrete from a top end thereof to form the wall.

According to a still further broad aspect of the present invention, there is provided a form system for a composite structural steel wall reinforced with concrete. The form system comprises a corrugated steel sheet having a plurality of integrally formed, alternately inverted, spaced ridges extending vertically along the form between opposed wall structures secured to at least some of the ridges on opposed sides of the corrugated steel sheet. The ridges have opposed integrally formed side walls having openings therein. Some of the openings are positioned to receive reinforcing steel rods therein. At least one of the opposed wall structures constitute an internal wall structure of a room of a building structure being formed. The opposed wall structure is secured in spaced-apart, substantially parallel, relationship by the corrugated steel sheet. Support means is provided for maintaining the form in a vertical upright position whereby concrete can be poured between the opposed wall structures from a top end of the form and between the spaced ridges which extend vertically therein.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
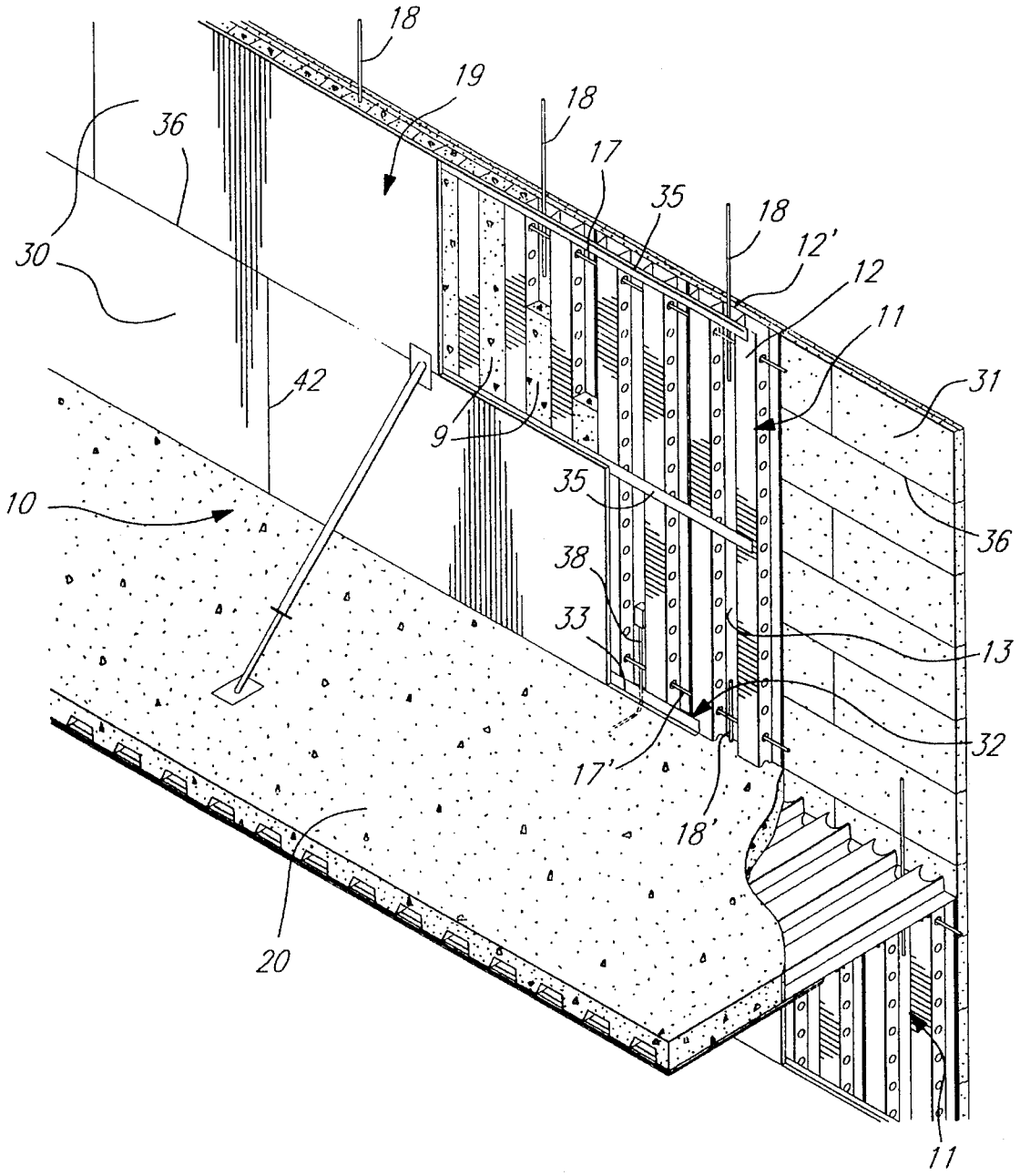
FIG. 1 is a fragmented perspective view illustrating the construction of a composite structural steel wall of the present invention reinforced with concrete and wherein the wall is an exterior wall.

Referring now to the drawings, and more particularly to FIG. 1, there is shown generally at 10, a composite structural steel wall constructed in accordance with the present invention and reinforced with concrete 9. The wall comprises a corrugated steel sheet 11 defined by a plurality of integrally formed, alternately inverted, spaced ridges 12 and 12' provided on opposed sides of the sheet 11 and separated by troughs 13 defined by a rear face 14 of the ridges on an opposite one of the sides of the sheet and opposed integrally formed side wall 15 of opposed ridges 12" disposed on a common side of the sheet, as better illustrated in FIG. 3. As shown, the side walls 15 are provided with openings 16 which are horizontally aligned whereby to receive, in at least the top and bottom end portions of the corrugated steel sheet 11, horizontal structural steel rods 17. To these horizontal steel rods 17 are secured, if required, transverse vertically extending reinforcing rods 18 to provide reinforcement in joints formed between vertically extending walls 19 and horizontally extending slabs 20. The vertically extending reinforcement rods 18 may be substituted by overlapping the ends of the corrugated steel sheets of adjacent vertically extending walls. Reinforcement joints are thus provided by overlapping the corrugated steel sheet of the wall of the next level to the extending sheet of the lower level, as designated by reference numeral 60 in FIG. 10.

Figure 3:
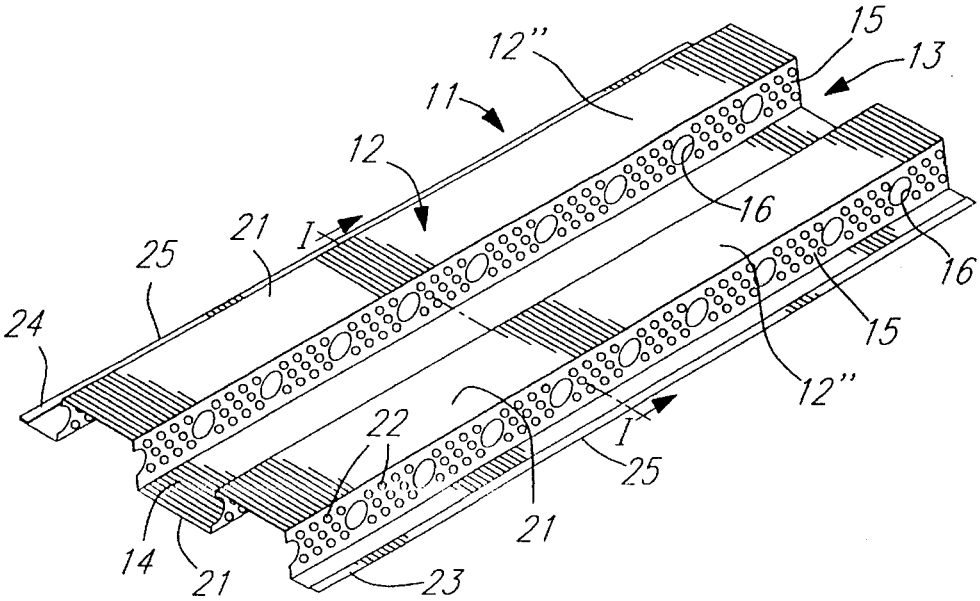
FIG. 3 is a perspective view illustrating the construction of the corrugated steel sheet.
Figure 4:
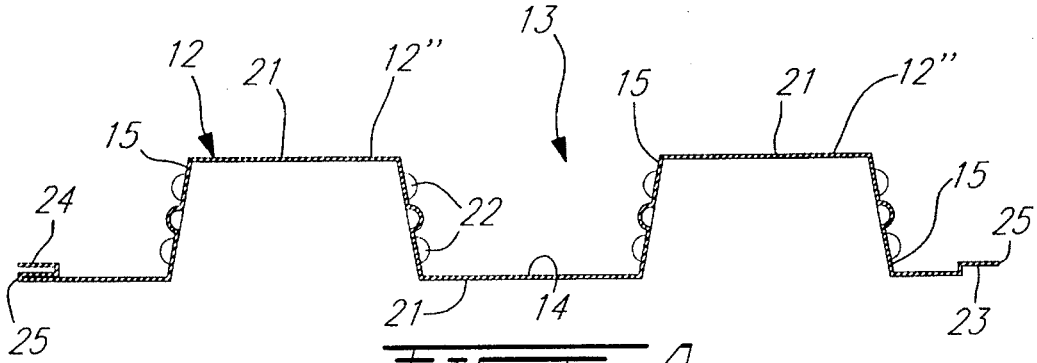
FIG. 4 is an end view along cross-section line I—I of FIG. 3.
Figure 5:
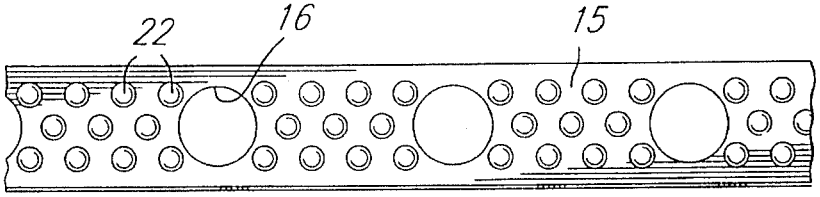
FIG. 5 is a plan view of the side wall.

With particular reference to FIG. 3, the corrugated steel sheet is a preformed, thin-walled, galvanized flexible steel sheet with the ridges 12 and 12' having flat crest surfaces 21. The side walls 15 are also flat walls and are provided with reinforcing beads 22 to provide full composite effect between the side walls and the concrete. Elongated connectors 23 and 24 are also provided along opposed vertical end edges 25 of the corrugated steel sheet 11 for interconnecting two or more of the corrugated steel sheets 11 in side-by-side relationship so that these extend along a complete wall, such as the vertically extending wall 19, as shown in FIG. 1. The end edges portions of the sheet 11 also have a portion of one of the troughs formed therein whereby when the connector 23 is received within the connector 24, a trough is formed between opposed side walls positioned to each side of the interconnected connectors.

Figure 2:
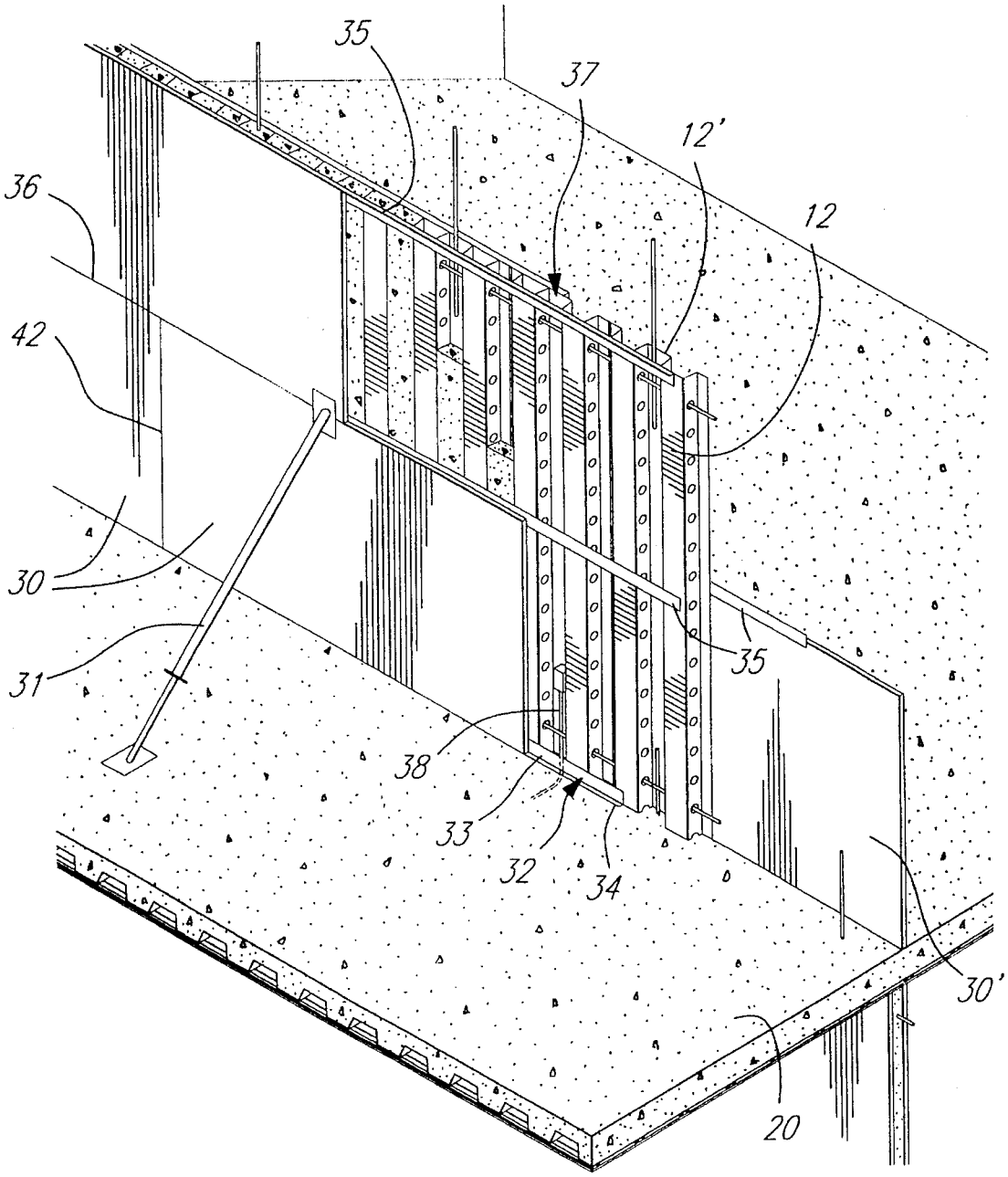
FIG. 2 is a view similar to FIG. 1 but wherein the composite structural steel wall reinforced with concrete is an internal partition wall.
Figure 6A:
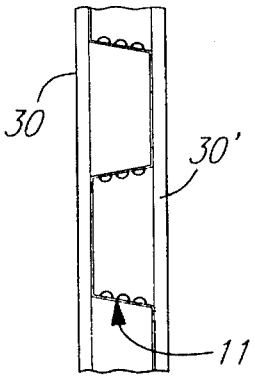
FIG. 6A is a top view illustrating a form formed by the corrugated steel sheet and opposed wall structures constituted by gypsum boards.
Figure 7A:
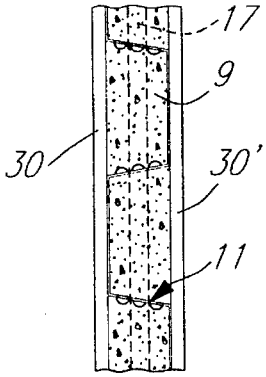
FIG. 7A is a view similar to FIG. 6A but showing the location of a horizontal reinforcing steel rod extending through the side walls of the spaced ridges with concrete poured between the opposed wall structures.
Figure 6B:
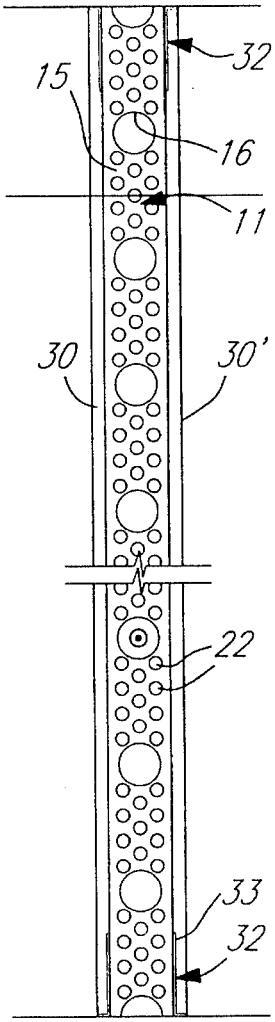
FIG. 6B is a side end view of FIG. 6A.
Figure 7B:
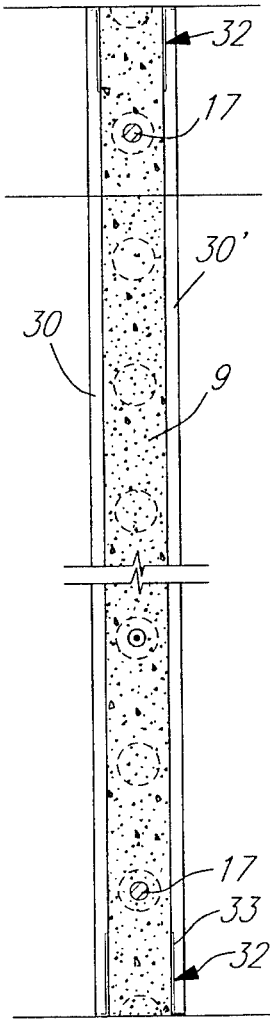
FIG. 7B is side end view of FIG. 7A.
Figure 8B:
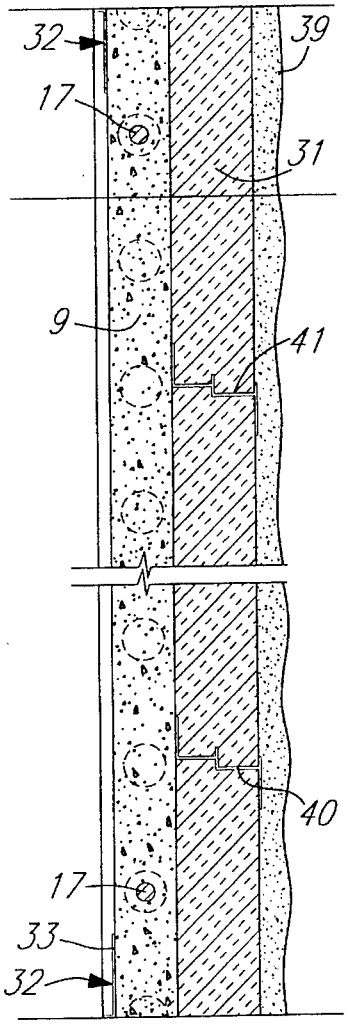
FIG. 8B is a side end view of FIG. 8A.

Referring again, to FIGS. 1 and 2 and FIGS. 6A to 8B, there is shown the manner in which the composite structural steel wall reinforced with concrete 9 is formed. Firstly, of form is formed by a corrugated sheet 11 or a plurality of interconnected ones of these sheets are supported upright or laid on a floor with a first wall structure, herein constituted by a plurality of gypsum sheets 30, secured to at least some of the flat crest surfaces 21 of the ridges 12 to constitute a wall structure. An opposed or second wall structure, herein constituted in FIG. 1 by insulated foam panels 31, is secured to the flat crest surfaces 21 of the opposed ridges 12' so as to constitute an external surface of the form and to form part of an external finished wall. If the wall is to be an internal partition wall, then further gypsum boards 30' are connected to the opposed ridges 12', as shown in FIG. 2. This provides a form as shown in FIGS. 6A and 6B, whereby to receive concrete 9 from a top end thereof. Form braces 31 are provided as necessary depending on the length and size of the wall.

Additionally, as shown in FIGS. 1 and 2, a reinforcing brace member, herein constituted by a right-angle metal strip 32, comprised of a vertical flange 33 for securement to at least some of the ridges 12 or 12', and a horizontal flange 34 for securement to an adjacent floor slab 20, is secured along a bottom edge of the corrugated steel wall panel 11 prior to securing the gypsum boards 30 and 30' to the ridges. These reinforcing brace members 32 also help in aligning the wall and supporting it upright in a vertical plane. Additional flat metal strips 35 may also be secured at predetermined locations in horizontal planes across the ridges to coincide with horizontal joints 36 formed between the sheet panels 30 or 31. They also provide additional rigidity.

Referring again to FIGS. 6A to 8B, it can be seen that the wall structures or panels 30 and 30' are supported substantially parallel to one another by the corrugated metal sheet 11 and concrete 9 is poured from the top end 37 of the form. Concrete will flow within the troughs 13 through the openings 16 formed in the side walls 15. Prior to the pouring of concrete, conduits, such as 38, for electrical wiring or plumbing, are positioned and secured within the troughs 13 or between horizontally aligned openings 16 in the side walls 15.

Figure 8A:
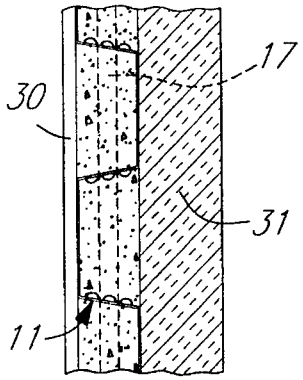
FIG. 8A is view similar to FIG. 6A but with one of the wall structures being an outside wall formed of insulating panels secured to the spaced ridges on a side forming the outer side of an outside wall.

After the concrete is set, the braces 31 are removed and the vertical wall is a rigid finish wall with the opposed wall structures 30 and 30' forming the finished internal walls of a room of a building structure. To the outer skin of the insulating foam panels 31, which form part of an external wall, there would then be secured an exterior finishing material 39, as shown in FIG. 8A. Securing brackets 40 are also attached to the flat crest surfaces 21 of the ridges to secure the insulating foam panels 31 in position. As herein shown, the foam panels 31 are provided with horizontal overlapping ridges 41 and this provides better seals between interconnected panels and the brackets 40 resist pressures from the poured concrete. The maximum force or pressure of concrete will be along the lower edge of the form where the reinforcing brace member 32 is provided. The strips 35 also prevent concrete from leaking or applying pressure in the horizontal joints 36. The vertical joints 42 are, of course, preferably disposed along the flat crested surfaces of the vertically extending ridges.

Figure 9:
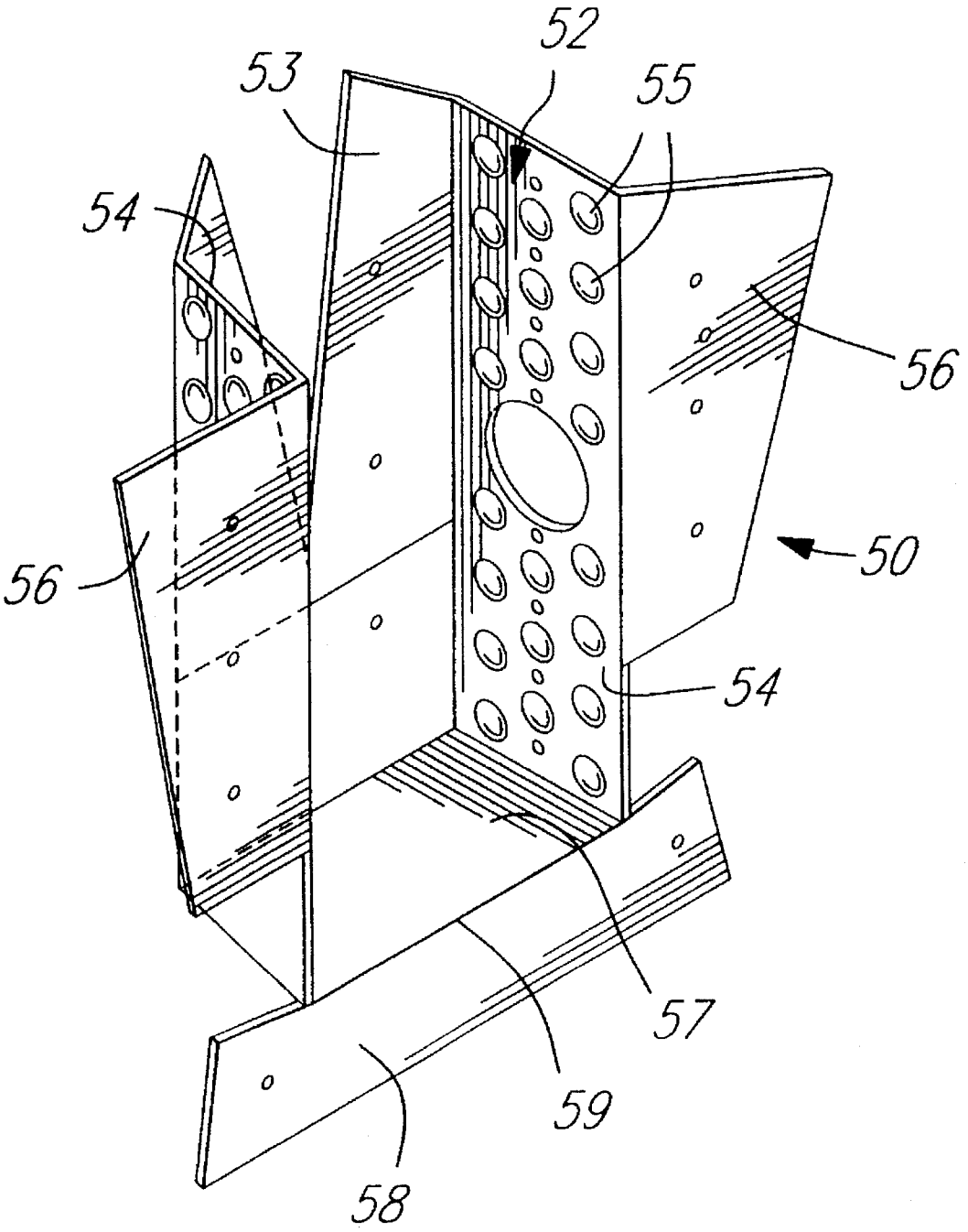
FIG. 9 is a perspective view of a joist support bracket securable to the corrugated steel sheet for supporting and connecting horizontal support joists to the wall structure.
Figure 10:
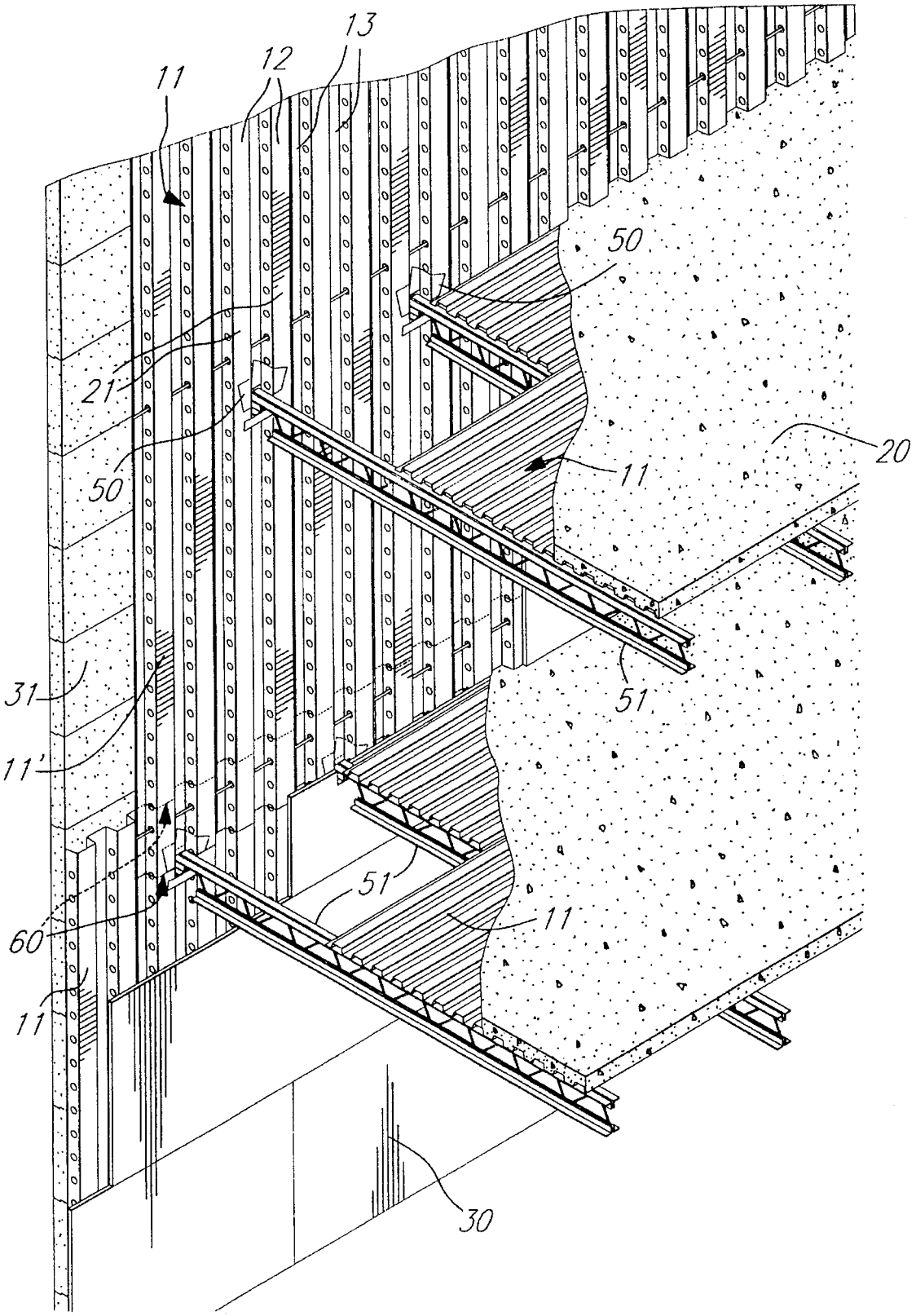
FIG. 10 is a perspective view showing a multi-storey structure with brackets having been secured to the wall structure for supporting floor joists.

Referring now to FIGS. 9 and 10, there is shown the construction of a joist support bracket 50 which is securable between a pair of opposed ones of the spaced ridges 12, as shown in FIG. 10. These joist support brackets 50 are secured at predetermined locations along a horizontal plane of the corrugated metal sheet in a top end thereof whereby to receive a respective end of a horizontal support joist 51 as shown in FIG. 10.

As shown in FIG. 9, the joist support bracket 50 comprises a trough section 52 defined by a bottom wall 53 and opposed side walls 54 which are configured to lie over wall sections of the troughs 13 defined between the spaced ridges 12. The opposed side walls 52 of the bracket have beads 55, slightly bigger than beads 22 of side wall 15. The layout of the beads 55 is disposed so as to cover the beads 22 of side walls 15. A connecting wing 56 is formed at a free end of the opposed side walls 54 of the bracket for securement to the flat crest surfaces 21 of the ridges 12. A base wall 57 spans a lower edge of the opposed side walls 54 of the bracket and has a connecting wing 58 along a front edge 59 thereof. The connecting wing 58 lies in a common plane with the connecting wings 56 of the side walls 54 for securement to the pair of opposed ones of spaced ridges 12. It is pointed out that these joists 51 are supported in their respective joist support brackets prior to the pouring of concrete so that they are connected to the side walls by the set concrete.

It can be appreciated that the construction of a composite structural steel wall, as herein defined, reinforced with concrete, provides numerous advantages not heretofore offered by the prior art. The elements used for the opposed wall structures constitutes an integral part of the finished wall as well as providing the form for the concrete which is poured from the top end. Erecting structural steel walls of this type require very little machinery and building components such as scaffolding, formwork, braces, etc., and renders the system economical. The system is also easy to erect in very short time periods and permits building structures to be erected more quickly and more economically. It also permits the construction of strong thin web wall structures and requiring very limited skilled labor.

It is within the ambit of the present invention to cover other obvious modifications of the preferred embodiment described herein, provided such modifications fall within the scope of the appended claims.

I claim:

1. A composite structural steel wall reinforced with concrete, said wall comprising a corrugated steel sheet defining a plurality of integrally formed, alternately inverted, spaced ridges; said ridges on opposed sides of said sheet being separated by troughs defined by a rear face of said ridges on an opposite one of said sides and an integrally formed side wall of opposed ridges on a common side, said side walls having openings therein, at least some Of said openings in each said steel walls being aligned with one another to receive reinforcing steel elements, a first wall structure secured to at least some of said ridges on one of said opposed sides of said corrugated steel sheet and extending entirely thereover, a second wall structure secured to at least some of said ridges on the other of said opposed sides of said corrugated steel sheet and also extending entirely thereover, said first and second wall structures forming at least an integral part of the finished wall surfaces and being spaced apart and interconnected substantially parallel to one another by said corrugated steel sheet whereby to constitute a form to receive concrete from a top end thereof to form said wall, said holes permitting the flow of said concrete between adjacent troughs, said first wall structure being an internal vertical wall structure of a room of a building structure, said second wall structure is an integral part of an outer vertical wall structure of said building structure.

2. A composite structural steel wall system as claimed in claim 1 wherein said second wall structure is an external insulated wall structure.

3. A composite structural steel wall system as claimed in claim 1 wherein said internal wall structure is formed by a plurality of gypsum sheets secured to at least some of said ridges by fasteners applied externally of said gypsum sheet.

4. A composite structural steel wall system as claimed in claim 3 wherein said second wall structure is an opposed internal wall structure of an opposite room of said building structure.

5. A composite structural steel wall system as claimed in claim 1 wherein there are openings in all of said side walls, said reinforcing steel elements being horizontal reinforcing steel rods disposed in said openings that are aligned with one another, and intersecting steel rods secured to said horizontal reinforcing steel rods and extending partly from said top end of said form.

6. A composite structural steel wall system as claimed in claim 1 wherein there is further provided a reinforcing brace member secured to at least some of said ridges on one of said opposed sides and disposed along a lower edge of said corrugated steel sheet.

7. A composite structural steel wall system as claimed in claim 6 wherein said reinforcing brace member is a right-angle metal strip having a vertical flange for securement to said at least some of said ridges, and a horizontal flange for securement to an adjacent floor surface.

8. A composite structural steel wall system as claimed in claim 6 wherein there is further provided additional flat metal strips disposed at predetermined locations to coincide with horizontal joints formed by sheet panels forming said first and second wall structures.

9. A composite structural steel wall system as is claimed in claim 1 wherein said corrugated steel sheet is a preformed, thin-wall, flexible steel sheet, said spaced ridges each having a flat crest surface, said side walls being flat walls, and reinforcing beads formed in at least said side walls to provide additional rigidity to said sheet.

10. A composite structural steel wall system as claimed in claim 1 wherein there is further provided elongated connectors along opposed vertical end edges of said corrugated steel sheet for interconnecting two or more of said corrugated steel sheets in a side-by-side relationship, said corrugated steel sheet having a portion of one of said troughs formed at opposed vertical end edge portions thereof.

11. A composite structural steel wall system as claimed in claim 1 wherein there is further provided support means for maintaining said form in a vertical upright position.

12. A composite structural steel wall system as claimed in claim 1 wherein there are openings in all of said side walls, said openings being aligned with one another, there being further provided horizontal steel rods disposed in said aligned opening near an end of said corrugated steel sheet to interconnect overlapping portions of steel sheets positioned end to end, said overlapping portions providing for vertical reinforcement of said steel wall between adjacent vertical walls.

13. A form system for a composite structural steel wall reinforced with concrete, said form system comprising a corrugated steel sheet defining a plurality of integrally formed, alternately inverted, spaced ridges; said ridges on opposed sides of said sheet being separated by troughs defined by a rear face of said ridges on an opposite one of said sides and an integrally formed side wall of opposed ridges on a common side, said side walls having openings therein, at least some of said openings in each said steel walls being aligned with one another to receive reinforcing steel elements, a first wall structure secured to at least some of said ridges on one of said opposed sides of said corrugated steel sheet and extending entirely thereover, a second wall structure secured to at least some of said ridges on the other of said opposed sides of said corrugated steel sheet and also extending entirely thereover, said first and second wall structures forming at least an integral part of the finished wall surfaces and being spaced apart and interconnected substantially parallel to one another by said corrugated steel sheet whereby to constitute a form to receive concrete from a top end thereof to form said wall, said holes permitting the flow of concrete between adjacent troughs, said first wall structure being an internal vertical wall structure of a room of a building structure, said second wall structure is an integral part of an outer vertical wall structure of said building structure, wherein said openings in said side walls are horizontally aligned openings, there being further provided horizontal reinforcing steel rods disposed in some of said aligned openings, and intersecting steel rods secured to said horizontal reinforcing steel rods and extending partly from said top end of said form.

14. A form as claimed in claim 13 wherein there is further provided a reinforcing brace member secured to at least some of said ridges on one of said opposed sides and disposed along a lower edge of said corrugated steel sheet.

15. A form as claimed in claim 14 wherein said reinforcing brace member is a right-angle metal strip having a vertical flange for securement to said at least some of said ridges, and a horizontal flange for securement to an adjacent floor surface.

16. A form as claimed in claim 14 wherein there is further provided additional flat metal strips disposed at predetermined locations to coincide with horizontal joints formed by sheet panels forming said first and second wall structures.

17. A form as claimed in claim 13 wherein said corrugated steel sheet is a preformed, thin-wall, flexible steel sheet, said spaced ridges each having a flat crest surface, said side walls being flat walls, and reinforcing beads formed in at least said side walls to provide a composite effect with said concrete.

18. A form as claimed in claim 13 wherein there is further provided elongated connectors along opposed vertical end edges of said corrugated steel sheet for interconnecting two or more of said corrugated steel sheets in a side-by-side relationship, said corrugated steel sheet having a portion of one of said troughs formed at opposed vertical end edge portions thereof.

19. A composite structural steel wall connected in a form as claimed in claim 1 or 13 wherein there is further provided a plurality of joist support brackets secured between a pair of opposed ones of said spaced ridges at predetermined locations along a horizontal plane of said corrugated metal sheet to receive an end of a respective joist therein.

20. A composite structural steel wall as claimed in claim 19 wherein each said joist support brackets comprise a trough section defined by a bottom wall and opposed side walls configured to lie over wall sections of said troughs defined between said spaced ridges, said opposed side walls of said bracket having beads therein for registry with said beads in said side walls of said ridges, a connecting wing formed at a free end of said opposed side walls of said bracket for securement to said pair of opposed ones of said spaced ridges, a base wall spanning a lower edge of said opposed side walls of said bracket and having a connecting wing along a front edge thereof lying in a common plane with said connecting wing of each side wall of said bracket for securement to said pair of opposed ones of said spaced ridges.

* * * * *